US009129761B2

(12) United States Patent
Gerving et al.

(10) Patent No.: US 9,129,761 B2
(45) Date of Patent: Sep. 8, 2015

(54) SWITCHING DEVICE SUITABLE FOR DIRECT CURRENT OPERATION

(71) Applicant: Eaton Electrical IP GmbH & Co. KG, Schoenefeld (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/133,815

(22) Filed: Dec. 19, 2013

(65) Prior Publication Data

US 2014/0175056 A1 Jun. 26, 2014

(30) Foreign Application Priority Data

Dec. 20, 2012 (DE) ..... 10 2012 112 772

(51) Int. Cl.
*H01H 9/34* (2006.01)
*H01H 9/36* (2006.01)
(Continued)

(52) U.S. Cl.
CPC ..... *H01H 9/346* (2013.01); *H01H 9/36* (2013.01); *H01H 9/40* (2013.01); *H01H 9/443* (2013.01); *H01H 33/182* (2013.01)

(58) Field of Classification Search
CPC . H01H 50/546; H01H 9/34; H01H 2071/086; H01H 33/596; H01H 50/14
USPC ..... 218/4, 34, 103, 109, 144; 335/102, 132
See application file for complete search history.

(56) References Cited

U.S. PATENT DOCUMENTS 4,502,033 A * 2/1985 Grenier ..... 337/75
4,629,840 A 12/1986 Dirks et al.
(Continued)

FOREIGN PATENT DOCUMENTS

DE 1126479 B 3/1962
DE 1160922 A 1/1964
(Continued)

OTHER PUBLICATIONS

Erk, A., Schmelzle, M.: Grundlagen der Schaltgerätetechnik, Berlin, Springer-Verlag, pp. 282-293, ISBN 3-540-06075-8.
(Continued)

*Primary Examiner* — Truc Nguyen
(74) *Attorney, Agent, or Firm* — Leydig, Voit & Mayer, Ltd.

(57) ABSTRACT

A switching device includes at least a first current path and a second current path, each of which have a first connection and a second connection, whereby the first connections are arranged on the first side of the switching device and the second connections on the second side of the switching device, each current path has at least one contact pair, that has a first contact and a second contact, whereby at least the second contact is arranged on a contact member that is movable to the first contact and whereby in the switched-on status of the switching device, both the contacts are in contact with each other, each contact pair has at least one extinguishing device, whereby the extinguishing devices of both the current paths are arranged in a direction from the first connections to the second connections, behind one another and at least partly covering each other.

10 Claims, 5 Drawing Sheets

(51) Int. Cl.

| | |
|---|---|
| ***H01H 9/44*** | (2006.01) |
| ***H01H 33/18*** | (2006.01) |
| ***H01H 9/40*** | (2006.01) |

(56) References Cited

U.S. PATENT DOCUMENTS

| | | | | |
|---|---|---|---|---|
| 5,004,874 | A * | 4/1991 | Theisen et al. | 218/151 |
| 5,138,122 | A * | 8/1992 | Moldovan et al. | 218/22 |
| 5,416,455 | A * | 5/1995 | Moldovan et al. | 335/132 |
| 6,194,984 | B1 * | 2/2001 | Kappel et al. | 335/132 |
| 6,373,014 | B1 * | 4/2002 | Mitsuhashi et al. | 218/22 |
| 6,700,466 | B1 * | 3/2004 | Yamamoto et al. | 335/132 |
| 2009/0127229 | A1 | 5/2009 | Schmitz et al. | |
| 2014/0263186 | A1 | 9/2014 | Gerving et al. | |
| 2014/0284310 | A1 | 9/2014 | Gerving et al. | |
| 2014/0347151 | A1 | 11/2014 | Gerving et al. | |

FOREIGN PATENT DOCUMENTS

| | | | |
|---|---|---|---|
| DE | 3412566 | C2 | 10/1985 |
| DE | 102006016273 | A1 | 10/2007 |
| EP | 0789372 | B1 | 8/1997 |
| EP | 2061053 | A2 | 5/2009 |
| WO | 2013064629 | A1 | 5/2013 |
| WO | 2013076299 | A1 | 5/2013 |
| WO | 2013076310 | A1 | 5/2013 |
| WO | 2013079508 | A1 | 6/2013 |
| WO | 2013092348 | A1 | 6/2013 |

OTHER PUBLICATIONS

German Office Action issued on Jan. 21, 2013, German Patent Office.

* cited by examiner

SWITCHING DEVICE SUITABLE FOR DIRECT CURRENT OPERATION

CROSS-REFERENCE TO RELATED APPLICATIONS

Priority is claimed to German Patent Application No. DE 10 2012 112 772.7, filed on Dec. 20, 2012, the entire disclosure of which is hereby incorporated by reference herein.

FIELD

The invention involves a switching device suitable for direct current operation which comprises of at least a first current path and a second current path, each having a first connection and a second connection, whereby the first connections are arranged on the first side of the switching device and the second connections are arranged on a second side of the switching device. At least one contact pair is provided for each current path, each of which has a first contact and a second contact, whereby at least the second contact is arranged on a contact member that is movable in relation to the first contact and whereby the two contacts are in contact with each other when the switching device is switched on. Each contact pair is provided with at least one extinguishing device for extinguishing any electric arc occurring between the contacts.

BACKGROUND

Such a switching device is known from EP2 061 053 A2. For creating a switching device for direct current applications it is recommended that the housing of a switching device for alternating current applications be used, whereby additionally a magnet is provided, which is creates a magnetic field with field lines predominantly transverse to the isolation gaps of current paths of the alternating current switching device. In the housing there are three receiving regions for each single current path, whereby each current path is assigned a moveable switching contact element as well as two fixed switching contact elements opposite each other. The three moveable switching contact elements can be moved together, between a closed position which corresponds to the switched-on status of the switching device, and an open position which corresponds to a switched-off status of the switching device. The individual current paths are each assigned two arc extinguishing devices in the form of extinguishing plates, arranged individually over one another and electrically insulated from each other. In addition, each current path has two separation sections which, when the movable switching contact elements are open, form between the ends of the movable switching elements and the first and second fixed switching element which are associated with the ends of the movable switching contact elements. On opening of the switching contact elements an arc, which can be extinguished with the help of an arc extinguishing devices, is formed along each separation section. Since arcs in direct current applications cannot be extinguished during zero current passing as in alternating current applications, a magnetic field that drives the arc into an arc extinguishing device has to be used in direct current applications. This magnetic field is built up by permanent magnets, whereby a magnetic field is built up with field lines in a direction which runs transverse to the separation sections and creates a Lorenz force on the arcs that form along these separation sections which drives an arc in the direction of an arc extinguishing device. In this connection, an arc between a first contact pair is driven in the direction of a first arc extinguishing device and the arc between a second contact pair is driven in the direction of the second arc extinguishing device. Since the movement of the arcs is dependent on the direction of the current, the switching device is suitable only for one current direction, i.e. poling. If the switching device is operated in the opposite current direction, the arcs will not be driven into the arc extinguishing devices but in the opposite direction onto a switching bridge. Even if the magnetic poling of one of the arcs is reversed, one of the arcs would run towards a switching bridge, which would result in reduced lifetime, since the switching bridge or other part would be damaged or even destroyed in the long-run.

The EP 0 789 372 B1 also shows a switching device of the type mentioned at the outset. A fixed contact is provided with a fixed arc runner which is circular-arc-shaped. A moveable arc runner is provided on a moveable contact, whereby an arc can form between the two arc runners which can be moved in different directions by the arc driver assembly in accordance with the direction of the current. In accordance with the direction of current this is diverted around a centre point, either in the first direction of rotation or in a second direction of rotation opposite to the first, whereby the centre point corresponds to the centre point of the fixed arc runner. An arc with the first direction of current is diverted into a first arc runner channel and an arc with a direction of current opposite to the first direction of current is diverted into the second arc runner channel. Both arc runner channels run around the centre point and are arranged next to each other separated by an insulating wall. The arc runner channels are part of an extinguishing device for extinguishing of the arc Further, the extinguishing devices comprise extinguishing plates which are radically oriented to the stationary arc channels. The extinguishing plates are arranged in such a way that they cover both the arc channels and therefore are part of both extinguishing devices.

An aspect of this invention is to provide a switching device that can be operated independent of polarity and one that is constructed in a simple manner.

SUMMARY

In an embodiment, the invention provides a switching device suitable for direct current operation, the device comprising: a first current path; and a second current path, wherein each of the first and second current paths includes a respective first connection and a respective second connection, and the first connections are arranged on a first side of the switching device and the second connections are arranged on a second side of the switching device. Each current path includes a respective contact pair having a first and a second contact. Each of the second contacts is arranged on a respective moveable contact member. In a switched-on status of the switching device, both the first and the second contacts are in contact with each other. Each contact pair includes a respective extinguishing device configured to extinguish an arc forming between the first and the second contacts. The extinguishing devices of both current paths are arranged in a direction from the first connections to the second connections behind one another and at least partly covering each other.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
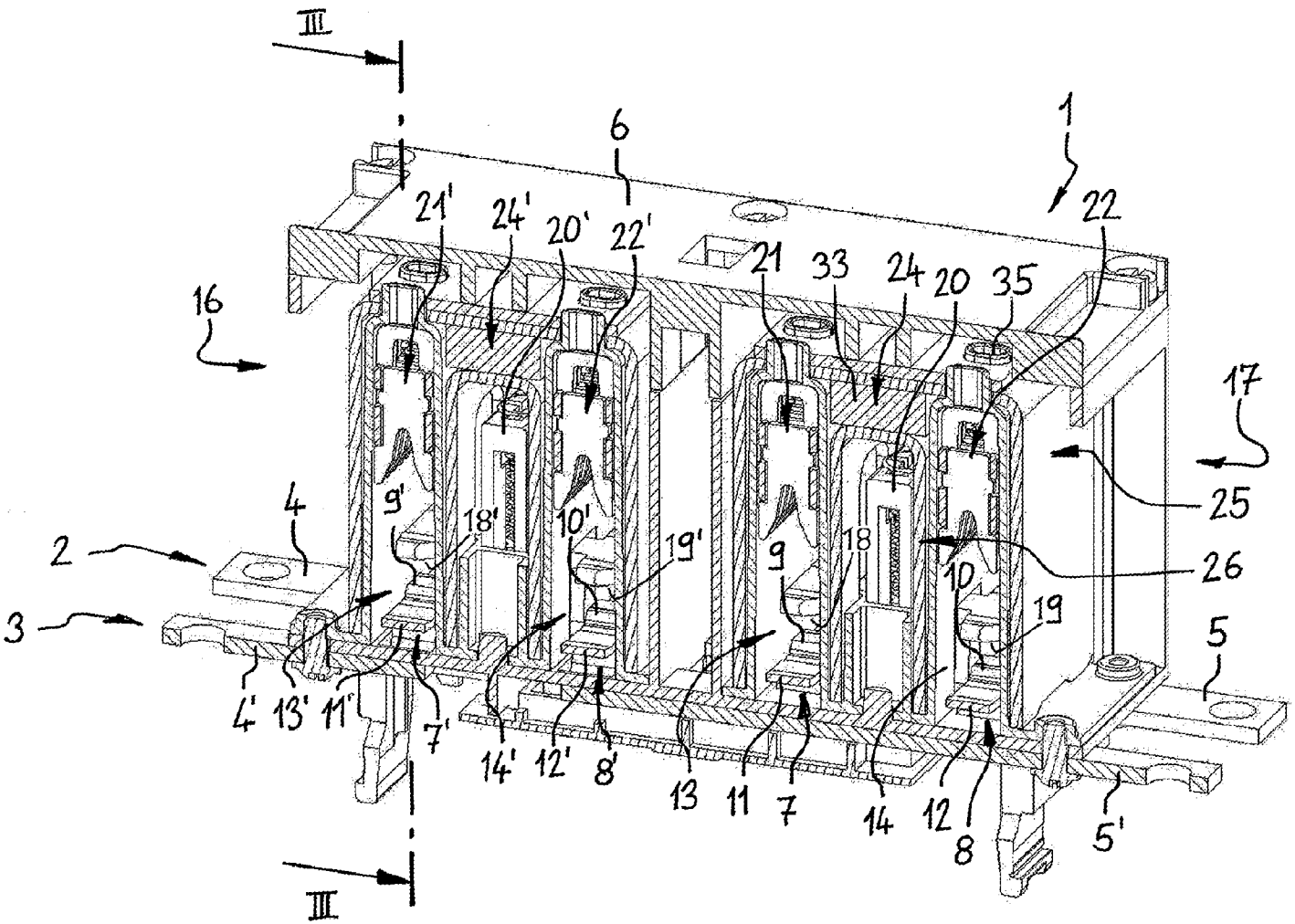
FIG. 1 shows a perspective longitudinal section of a switching device in accordance with this invention.

An advantage of the inventive arrangement is that due to the arranging of the extinguishing devices of both current paths one behind the other and due to the over covering or overlapping in direction between the first connections and the second connections, a very compact construction of the switching device is achieved. In many applications, the connections for incoming feed are on one side of the switching device and the connections for output on the other side of the switching device. The first connections and the second connections are therefore on sides facing away from each other. Generally, the extinguishing devices of two current paths, relative to the direction between the first connections and the second connections, are situated next to each other, so that a relatively broad shaped design of a switching device becomes necessary. Particularly then when the extinguishing devices are arranged in such a way that the arcs emanating for the contact pairs are driven into extinguishing chambers in a direction transverse to the corresponding current paths, the arrangement of the extinguishing devices one behind the other positively affects the outer dimensions of the switching device. In such an arrangement in which the arcs are driven transverse to the flow of the current paths into the extinguishing devices, the extinguishing devices are relatively broad when related to the breadth of the individual switching paths and would lead to larger dimensions of the switching device if arranged next to each other. The arrangement one behind the other and at least partly covering each other here is particularly positive. The current paths are preferably arranged somewhat parallel to each other, whereby the first side of the switching device faces away from the second side of the switching device.

As a rule, in a preferred construction, every extinguishing device has exactly one extinguishing chamber, whereby an arc with a first direction of current is directed into the mentioned extinguishing chamber in the first direction and an arc with a direction of current in a second direction is directed into the mentioned extinguishing chamber in a second direction. Therefore, every arc is directed into the same extinguishing chamber independent of its direction of current. Therefore, no two separate extinguishing devices or extinguishing chambers are necessary, which also positively influences the space required for construction. Here the extinguishing chamber is primarily arranged on one side of one of the two contacts of a contact pair which faces away from the other contact. In case of a movable contact and a fixed contact, the extinguishing chamber is located preferably on the side facing away from the fixed contact of the movable contact.

For guiding the arcs, every extinguishing device is provided with a first arc guiding arrangement and a second arc guiding arrangement, with the help of which any arc occurring between the contacts of a contact pair is guided into the extinguishing chamber of the appropriate extinguishing device to extinguish the arc.

The first arc guiding arrangement is designed in such a manner that an arc having a first direction of current is deflected in a first direction of rotation and guided in the direction of the extinguishing chamber. The second arc guiding arrangement is designed in such a manner that an arc having a second direction of current is deflected in a direction of rotation opposite to the first direction of rotation and guided in the direction of the extinguishing chamber.

In a preferred construction, the extinguishing chamber is designed as a Deion-extinguishing chamber with a multitude of extinguishing plates electrically insulated from each other, arranged parallel to each other. The arc guiding arrangements encompass in each case, a first guide plate and a second guide plate, whereby both the first guide plates going out from the first contact run in opposite directions. The first two guide plates take up the extinguishing device between themselves. The extinguisher plates are aligned preferably parallel to the direction of movement of the bridging contact member. Additionally, the extinguishing plates are parallel to the appropriate current path.

At least one arc driver assembly can be provided for driving an arc into the appropriate extinguishing device, which creates a magnetic field for the generation of a Lorenz force on the arc at least in the area of the contact pairs.

To be able to arrange the extinguishing devices behind one another relative to the direction between the first connections and the second connections as simply as possible, the first current path and the second current path are fashioned in such a way, that the contact pairs of the current paths relative to direction between the first contacts and the second contacts are arranged behind one another.

Two contact pairs can be provided for each current path, each of which builds a double interrupting switching arrangement with a first contact and a second contact, whereby the second contacts are arranged on a bridging contact member which can be moved to the first contacts which connects both the second contacts electrically with each other.

To be able to ensure a simple layout of the extinguishing devices behind one another in such an arrangement, it is preferable that the first current path and the second current path each have two contact supports which support the first contacts. Here, the contact supports of the first current path are arranged running in the direction of the second current path and the contact supports of the second current path are arranged running in the direction of the first current path.

Preferably here, the contact pairs of the first current path and the contact pairs of the second current path can be all arranged on a common axis, so that the extinguishing devices can be arranged behind one another, completely covering each other.

Preferably, the arc driver assembly should have an outer pole element and an inner pole element. Both pole elements are designed as U-shaped profiles, each with a base bridge and two pole plates jutting out from the base bridge. The inner pole element is placed within the outer pole element, whereby at least one permanent magnet is provided between the base bridges of both pole elements. A contact pair is arranged between one pole plate of the outer pole element and one pole plate of the inner pole element.

The electrical switching device 1 comprises in all, two poles, i.e. two current paths, namely a first current path 2 and a second current path 3. Basically, more than two current paths can be provided, whereby preferably two current paths in pairs as described below are provided. Both the current paths 2, 3 are each provided with a switching arrangement, as described in detail below, and can thus be electrically cut off. Both the current paths 2, 3 can each be integrated into a direct current circuit and can be used to interrupt a current flow.

Figure 2:
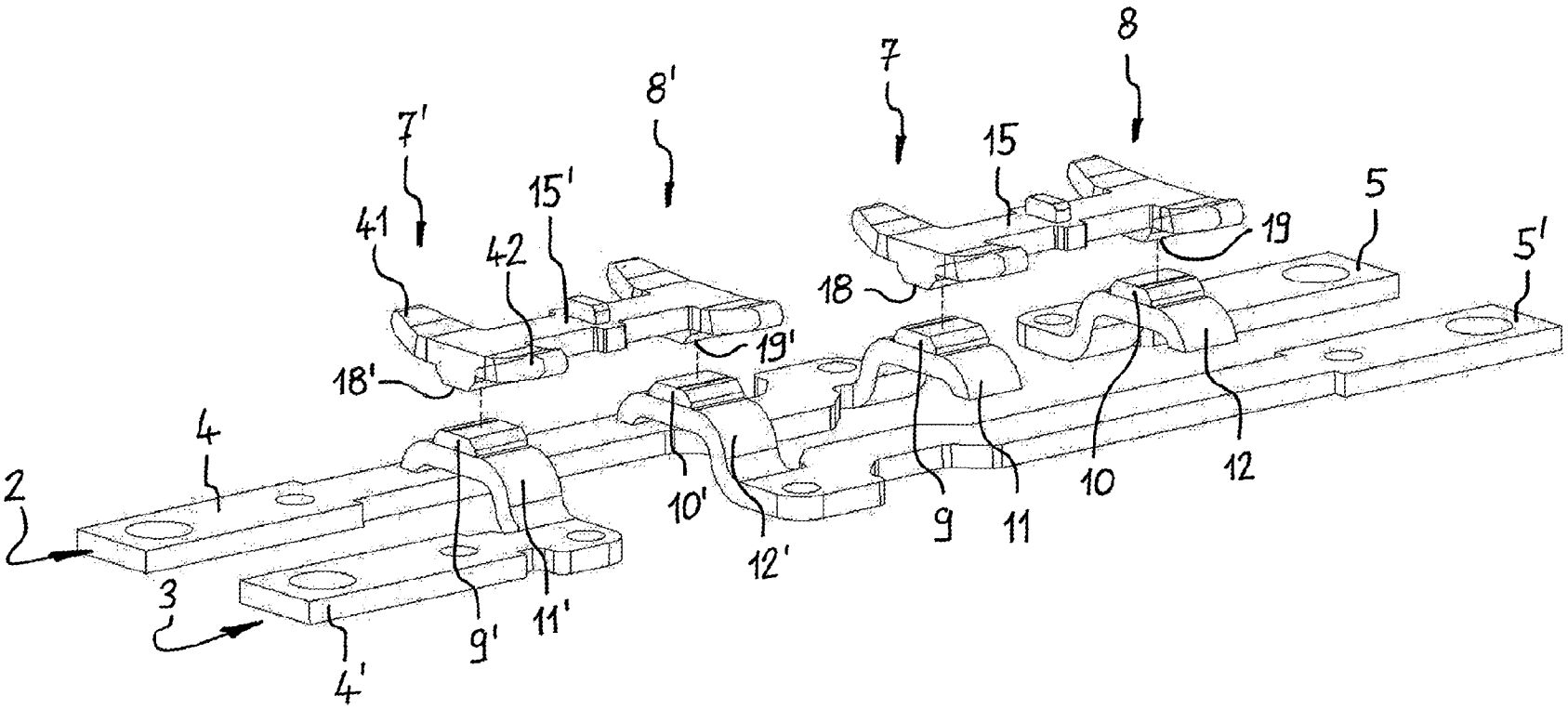
FIG. 2 shows a perspective representation of current paths in accordance with FIG. 1.

FIG. 1 shows the switching device with a housing 6 and the current paths 2, 3 inside it. FIG. 2, which will now be described along with FIG. 1, shows just the two current paths 2, 3.

The switching device 1 includes a housing 6, in which the switching arrangements are incorporated as described below. Current paths 2, 3 run next to each other from the first side 16 of the switching device 1 to a second side 17 of the switching device 1. The first current path 2 includes a first connection 4 and a second connection 5 for the purpose of connecting the first current path 2 with connections of a direct current circuit. Both the connections 4, 5 are located on opposite sides of the switching device 1 and protrude out of the housing 6. Correspondingly, the second current path 3 has a first connection 4' and a second connection 5', whereby the first connection 4' is located on the same side as the first connection 4 of the first current path 2. The second connection 5' of the second current path 3 is arranged on the same side as the second connection 5 of the first current path 2. In the description which follows, the first current path 2 will be described in more detail and is representative for both current paths 2, 3, whereby the second current path 3 is identically constructed, unless otherwise stated.

The first connection 4 leads to a first contact pair 7, which is arranged in the first switching chamber 13 of the housing 6. The second connection 5 leads to a second contact pair 8, which is arranged in the second switching chamber 14 of the housing 6. Both the switching chambers 13, 14 are electrically insulated from each other in the housing 6 and arranged in a direction from the first connection 4 to the second connection 5 one behind the other and covering each other. The first connection 4 is electrically connected to a contact support in the form of a fixed contact support 11 on which a first contact 9 of the contact pair 7 is arranged. A second contact 9 is arranged movable to the first contact 9. The second contact 18 as shown in the FIGS. 1 and 2 is adjustable vertically. The second contact 18 is provided on an electrically conducting contact support in the form of a bridging contact member 15 which is adjustable across a switching bridge 20. In the switched-on status, the first contact 9 and the second contact 18 are kept connected to each other. In a switched-off status as shown in one of the FIGS. 1 and 2, the first contact 9 and the second contact 18 have been kept disconnected to each other.

The second connection 5 leads to a first contact 10 of the second contact pair 8, which is arranged on another contact support in the form of a stationary contact support 12. A second contact 19 is kept movable to the first contact 10 of the second contact pair 8, which is also arranged on the bridging contact member 15 and is electrically connected to the second contact 18 of the first contact pair 7. Thus, both contact pairs 7, 8 can be opened or closed by adjusting the bridging contact member 15.

The fixed contact supports 11, 12 of both current paths 2, 3 are arranged in such a way that the first contacts (fixed contacts) are aligned on a common axis, whereby the axis runs parallel to a main direction of extent of both current pairs 2, 3.

When shifting the switching bridge 20 into an opened position, arcs, which must be extinguished, can form between the contacts 9, 18, 10, 19. An extinguishing device each 21, 22 is provided on the side facing away from the second contact 18, 19 of the first contacts 9, 10 for this purpose, whereby both extinguishing devices 21, 22 of both contact pairs 7, 8 are identically built. Here, a first extinguishing device 21 is assigned to the first contact pair 7 and a second extinguishing device 22 to the second contact pair 8. Both extinguishing devices encompass extinguishing plates 23, which are electrically insulated from one another, arranged parallel to each other and are themselves electrically conducting. Thus, they build a Deion-Extinguishing Chamber.

To be able to move arcs that form between the first contacts 9, 10 and the second contacts 18, 19 in the direction of the extinguishing devices 21, 22, an arc driving assembly 24 (FIG. 6) is provided. The arc driving assembly 24 consists of an outer pole element 25 and an inner pole element 26. Both pole elements 25, 26 each have a base bridge 27, 28, from which a first pole plate 29, 30 and a second pole plate 31, 32 protrude, whereby both pole plates 29, 30, 31, 32 of the pole elements 25, 26 run parallel to one another. The inner pole element 26 has smaller dimensions than the outer pole element 25, so that the inner pole element 26 can be arranged inside the outer pole element 25. Here, all pole plates 29, 30, 31, 32 of both pole elements 25, 26 are parallel and equidistant to one another. A gap is likewise provided between both base bridges 27, 28 of both pole elements 25, 26, whereby a permanent magnet 33 is arranged between both base bridges 27, 28. The first contact pair 7 is arranged between both the first pole plates 29, 30, and the second contact pair 8 is arranged between both the second pole plates 31, 32. The switching bridge 20 is arranged between the first pole plate 30 and the second pole plate 32 of the inner pole element 26.

Figure 6:
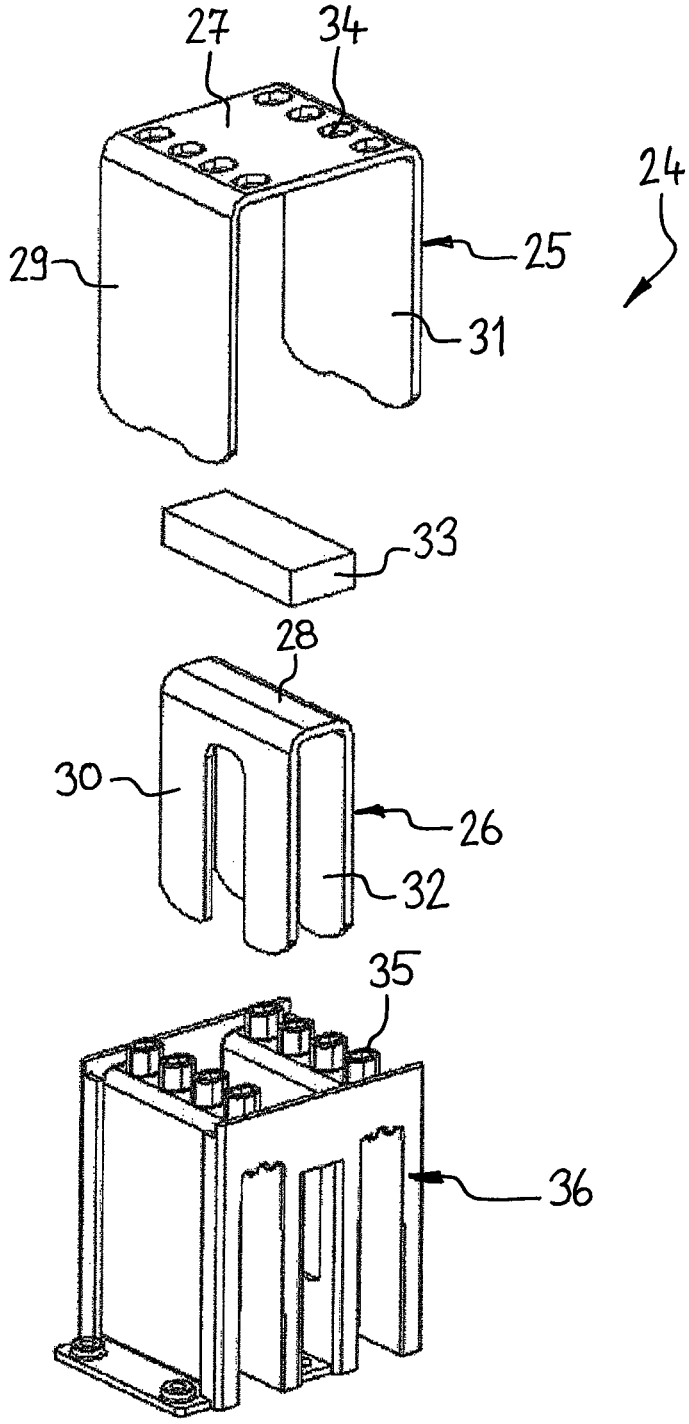
FIG. 6 shows an arc driver assembly of the switching device in accordance with FIG. 1.

The exact construction can also be seen from FIG. 6. Here one can see that a multitude of openings 34 are provided in the base bridge 27 of the outer pole element 25. These are meant for accommodating the exhaust ducts 35 of an insulating element 36. The insulating element 36 insulates the two switching chambers 13, 14 from each other, whereby the exhaust ducts 35 are meant for blowing out arc gasses from the switching chambers 13, 14 to the exterior.

The individual pole plates 29, 30, 31, 32 are arranged transverse to the current paths 2, 3 and cause a Lorenz force to act on an arc which forms between the contacts 9, 10, 18, 19, so that the arc can be driven into the extinguishing devices 21, 22.

Figure 3:
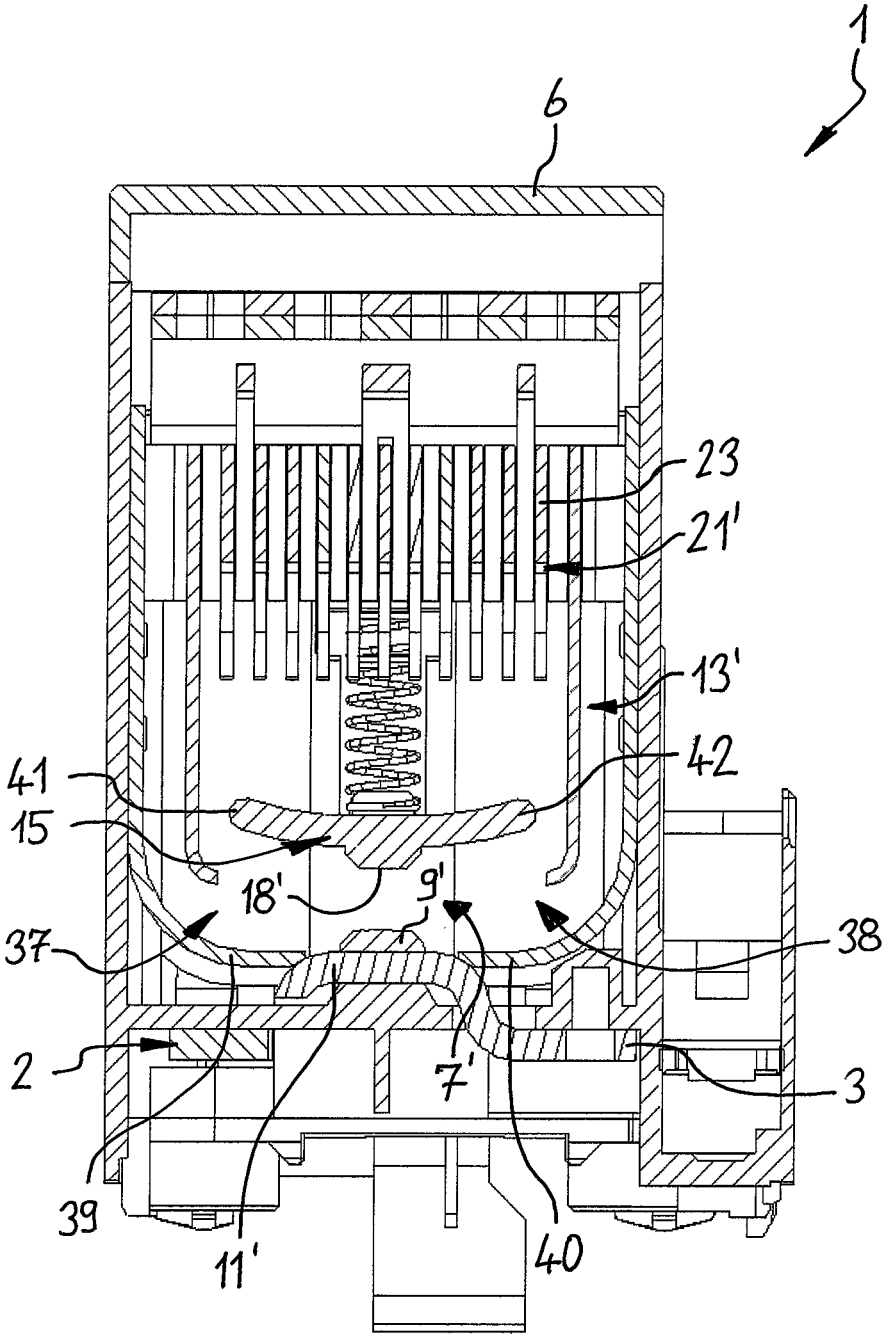
FIG. 3 shows a cross section of switching chamber of the switching device along the section III-III in accordance with FIG. 1.
Figure 4:
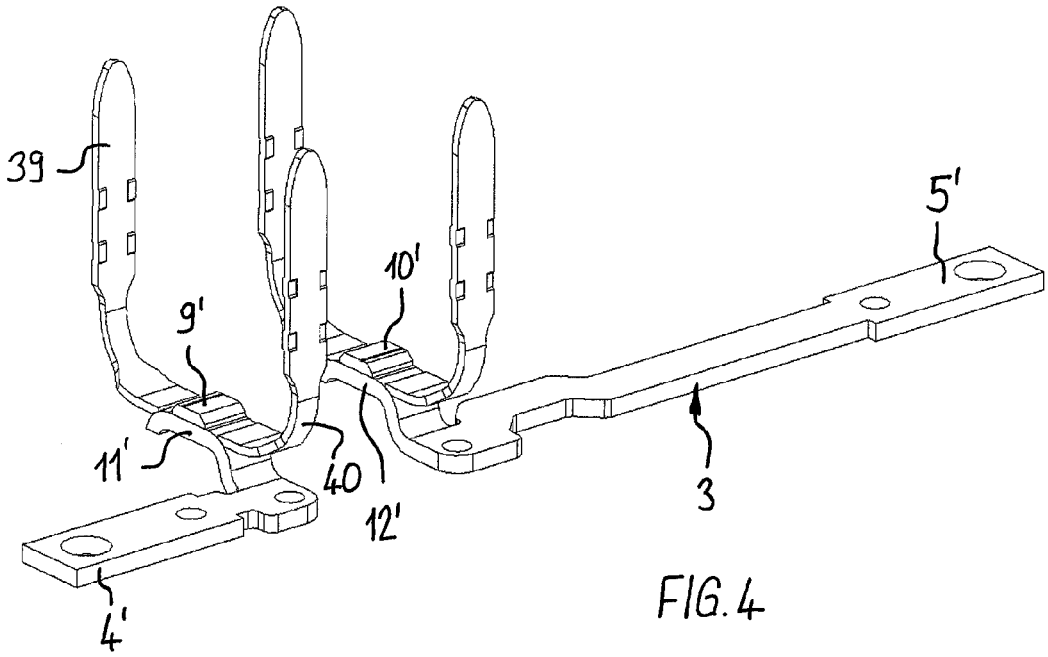
FIG. 4 shows a perspective representation of the second current path in accordance with FIG. 2 with arc guiding arrangements.
Figure 5:
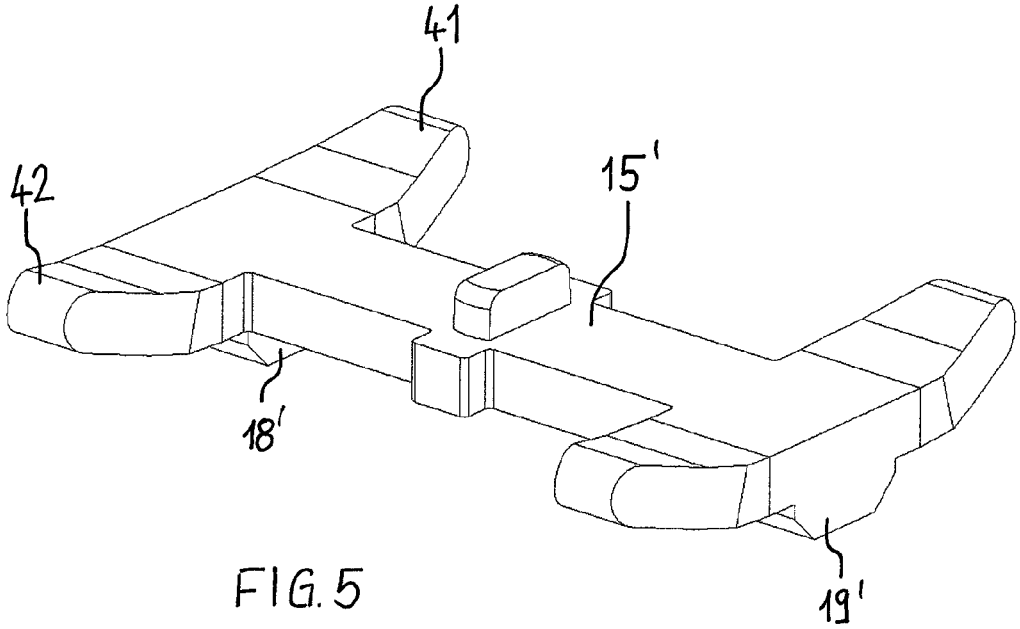
FIG. 5 shows a perspective representation of a bridging contact member in accordance with FIG. 2, with arc guiding arrangements

FIG. 3 shows a cross section through the first switching chamber 13. There one can see that a first arc guiding assembly 37 and a second arc guiding assembly 38 are provided for guiding an arc that forms between the first contact 9 and the second contact 18. The first arc guiding assembly 37 is meant for guiding an arc with a first direction of current into the first extinguishing device 21. The second arc guiding assembly 38 is meant for guiding an arc with a second direction of current into the first extinguishing device 21. Due to the formation of a homogenous magnetic field with field lines from one of the first pole plates 29 to the other of the first pole plates 30, the magnetic field lines are perpendicular to the arc, so that a Lorenz force acts on it and drives the arc sideways away from the contact pair 7. The arc is then driven to the right or left, depending on the direction of current in accordance with FIG. 3. If, in accordance with FIG. 3, the arc is driven to the left, the first arc guiding assembly 37 guides the arc. If, in accordance with FIG. 3, the arc is driven to the right, the second arc guiding assembly 38 guides the arc. Both arc guiding assemblies 37, 38 each have a first guide plate 39, 40 and a second guide plate 41, 42, between which the arc develops further. The first guide plates 39, 40 are connected to the first fixed contact support 11 (FIG. 4). The second guide plates 41, 42 are connected to the bridging contact member 15, whereby the second guide plates 41, 42 are formed as an integral unit with the bridging contact member 15 (FIG. 5).

The first guide plate 39 of the first arc guiding assembly 37 in FIG. 3 runs initially towards the left and is subsequently deflected 90° upwards, whereby the gap between the first guide plate 39 and the second guide plate 41 increases successively. The arc formed between these two guide plates 39, 41 therefore develops further and is then driven by the first contact pair 7 at a first direction of current towards the left and then upwards. Further, the arc will run along the rear side of the bridging contact member 15 facing away from the first contact 9, whereby the arc is successively driven into the gaps between the individual extinguishing plates 23. Exhaust ducts 35 are provided on the top side of the first switching chamber 13 to blow out the arc gases out of the housing 6.

The second arc guiding assembly 38 is built mirror-symmetrically identical.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 switching device
2 first current path
3 second current path
4, 4' first connection
5,5' second connection
6 housing
7,7' first contact pair
8,8' second contact pair
9,9' first contact
10, 10' first contact
11, 11' first contact support
12, 12' first contact support
13, 13' first switching chamber
14, 14' second switching chamber
15, 15' bridging contact member
16 first side
17 second side
18, 18' second contact
19, 19' second contact
20, 20' switching bridge
21, 21' first extinguishing device
22, 22' second extinguishing device
23 extinguishing plates
24, 24' first arc driving assembly
25, 25' outer pole element
26, 26' inner pole element
27 base bridge
28 base bridge
29 first pole plate
30 first pole plate
31 second pole plate
32 second pole plate
33 permanent magnet
34 opening
35 exhaust duct
36 insulating element
37 first arc guiding device
38 second arc guiding device
39 first guide plate
40 first guide plate
41 second guide plate
42 second guide plate
43 contact support element
44 guide plate element

The invention claimed is:

1. A switching device suitable for direct current operation, the device comprising:

a first current path; and a second current path, wherein each of the first and second current paths includes a respective first connection and a respective second connection, wherein the first connections are arranged on a first side of the switching device and the second connections are arranged on a second side of the switching device, wherein each current path includes a respective contact pair, having a first and a second contact, wherein each of the second contacts is arranged on a respective moveable contact member, wherein, in a switched-on status of the switching device, the first and the second contacts are in contact with each other so as to enable a first current to flow in the first current path and a second current to flow in the second current path, wherein each contact pair includes a respective extinguishing device configured to extinguish an arc forming between the first and the second contacts, and wherein the extinguishing devices of both current paths are arranged in a direction from the respective first connections to the respective second connections behind one another and at least partly covering each other.

2. The device of claim 1, wherein the extinguishing devices each include a respective extinguishing chamber, and wherein the extinguishing chambers are arranged such that the arc emanating from a contact pair is driven into the extinguishing chamber in a direction transverse to the current path.

3. The device of claim 2, wherein each extinguishing device includes only one extinguishing chamber, wherein the arc with a first direction of current is guided into the extinguishing chamber of the first path, and wherein the arc with a second direction of current is guided into the second extinguishing chamber of the second path.

4. The device of claim 2, wherein each of the extinguishing devices includes a first arc guiding arrangement and a second arc guiding arrangement, and wherein the arc guiding arrangements are configured to guide an arc emanating between the contacts of a respective contact pair into respective extinguishing chambers of respective extinguishing devices of the respective contact pair.

5. The device of claim 4, wherein each first arc guiding arrangement is arranged such that an arc with a first direction of current is diverted in a first direction of rotation and guided into the extinguishing chamber, and wherein each second arc guiding arrangement is arranged such that an arc with a second direction of current is diverted in a direction of rotation opposite to the first direction of rotation and guided into the extinguishing chamber.

6. The device of claim 4, wherein the extinguishing chambers are configured as deion-extinguishing chambers with two or more extinguishing plates insulated from each other, arranged parallel to each other, wherein the arc guiding arrangements each include a first guide plate and a second guide plate, wherein both the first guide plates originating from the first contact run in opposite directions, and wherein both the first guide plates take up the extinguishing chamber between them.

7. The device of claim 1, wherein the first current path and the second current path are configured such that the contact pairs of the current paths relative to the direction between the first contacts and the second contacts are arranged behind one another.

8. The device of claim 1, comprising two contact pairs for each current path, wherein the two contact pairs form a double interrupting switching arrangement with a first contact and a second contact, wherein the second contacts are arranged on a respective bridging contact member, which bridging contact member is movable to the first contacts and which bridging contact member electrically connects both the second contacts with each other, and wherein the contact pairs of the first current path and the contact pairs of the second current path are arranged on a common axis.

9. The device of claim 8, wherein the first current path and the second current path each include two contact supports which contact supports carry the contacts, wherein the contact supports of the first current path run in a direction of the second current path, and wherein the contact supports of the second current path run in a direction of the first current path.

10. The device of claim 1, further comprising:

a respective arc driver assembly configured to create a magnetic field at least in a region of each of the contact pairs, wherein each of the arc driver assemblies includes an outer pole element and an inner pole element, wherein both pole elements are configured as U-shaped profiles including a base bridge and two pole plates protruding from the base bridge, wherein the inner pole element is arranged within the outer pole element, wherein the inner pole element is arranged within the outer pole element, wherein at least one permanent magnet is arranged between the base bridges of both pole elements, so that the respective contact pair is between one pole plate of the outer pole element and one pole plate of the inner pole element.

* * * * *